United States Patent [19]

Hately

[11] Patent Number: 4,518,968

[45] Date of Patent: May 21, 1985

[54] DIPOLE AND GROUND PLANE ANTENNAS WITH IMPROVED TERMINATIONS FOR COAXIAL FEEDERS

[75] Inventor: Maurice C. Hately, Aberdeen, Scotland

[73] Assignee: National Research Development Corporation, London, England

[21] Appl. No.: 415,545

[22] Filed: Sep. 7, 1982

[30] Foreign Application Priority Data

Sep. 10, 1981 [GB] United Kingdom ..... 8127439

[51] Int. Cl.[3] ..... H01Q 9/16

[52] U.S. Cl. ..... 343/802; 343/803; 343/813; 343/815; 343/846

[58] Field of Search ..... 343/802, 793, 744, 722, 343/803, 813, 815, 846

[56] References Cited

U.S. PATENT DOCUMENTS 2,235,139 3/1941 Bruce ..... 343/795

FOREIGN PATENT DOCUMENTS 470165 8/1937 United Kingdom .
580812 9/1946 United Kingdom .
890367 2/1962 United Kingdom .
1182952 7/1967 United Kingdom .
1307496 2/1973 United Kingdom .

*Primary Examiner*—Eli Lieberman
*Assistant Examiner*—K. Ohralik
*Attorney, Agent, or Firm*—Cushman, Darby & Cushman

[57] ABSTRACT

Multiband dipole antennas connected to a coaxial feeder are usually not balanced and are not operated at maximum efficiency. In the present invention pairs of capacitors are connected at the feed point of respective half-wave dipoles, associated with different frequency bands to reduce these deficiencies. A similar technique is useful for single band half-wave dipoles and allows unbalanced multiband ground plane antennas to be constructed.

23 Claims, 9 Drawing Figures

DIPOLE AND GROUND PLANE ANTENNAS WITH IMPROVED TERMINATIONS FOR COAXIAL FEEDERS

Figure 1:
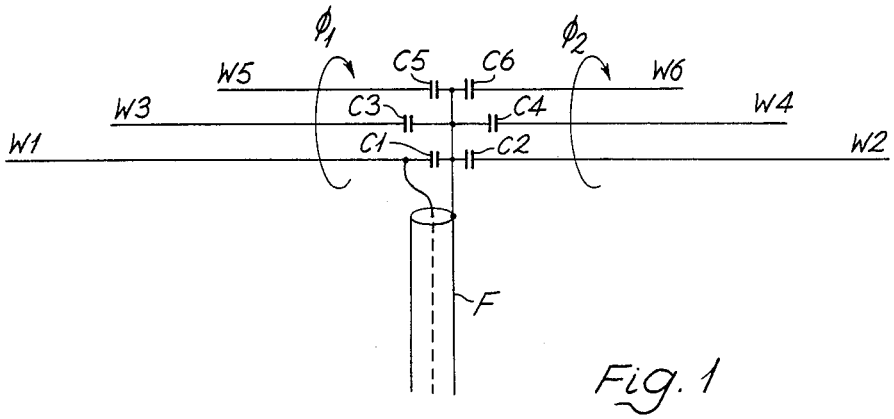

The present invention relates to single band and multiband dipole antennas and multiband ground-plane antennas having terminations which reduce losses and/or provide a balanced dipole when connected to a coaxial feeder.

Antennas used for most of the commercially occupied radio spectrum are either half-wave dipoles or developed forms of the half-wave dipole antenna. Such antennas in most previously known systems have been fed in one of two ways: using either a balanced feeder or a coaxial feeder. Each system possesses its own severe disadvantage in practice. Balanced feeders which are convenient to engineer are generally high impedance and therefore do not match the impedance of a centre cut in a half-wave resonant antenna. Coaxial feeders are better matched but, being unbalanced, disturb the field symmetry of balanced antennas such as the half-wave dipole and therefore depreciate the protection against local interfering fields afforded by the coaxial construction.

A transmitting antenna may be thought of as a radio frequency energy transformer in which the energy available at the feeder is coupled into space where the said energy radiates as an electromagnetic wave. A receiving antenna is the exact converse of the above and identical considerations apply and so does not require separate analysis. Since the travelling wave impedance of space is 377 ohms, and since most practical radio feeder impedances are in the region of 50 to 150 ohms, then the task of antenna design for efficient transformation is one of considerable challenge.

According to a first aspect of the present invention there is provided an antenna comprising:

coupling means including a capacitor;

a structure having two elongated generally parallel conductor portions of different lengths in close proximity but insulated from one another and each having first and second ends, and one of a conductive ground plane generally normal to said two conductor portions and at least one other oppositely directed elongated conductor portion of the same length as one of said two conductor portions with one end adjacent to, and capacitively coupled through said coupling means to said first ends of said two conductors; and first and second connecting points for the connection of the inner and outer conductors, respectively, of a coaxial feeder, the first connecting point being coupled to said first end of the longer of said two conductor portions, said capacitor being coupled between said second connecting point and said first end of the shorter of said two conductor portions, said capacitor providing a phase shift of several tens of degrees between voltage and current applied to said capacitor at a frequency at which said conductor portion connected thereto has a resonant length.

In this specification a resonant length at a frequency means any practical odd integral number of quarter wavelengths at that frequency.

Where an antenna according to the invention is a half-wave dipole comprising two oppositely directed elongated conductors, each substantially a quarter wavelength long at the said frequency, two capacitors are employed, one capacitor being connected as specified above. Preferably a half-wave dipole according to the invention also includes a further conductor which is insulated from, but in close proximity with throughout substantially its whole length, the said one elongated conductor but is significantly shorter. The further elongated conductor is connected to the first connecting point by way of the other capacitor, and a further capacitor may be connected between the said one elongated conductor and the second connecting point.

One important advantage of using a capacitor connected across the first and second connecting points is now explained with reference to a half-wave dipole.

When stimulated at the appropriate radio frequency, a half-wavelength conductor behaves as if it holds standing waves of electric and magnetic fields upon itself due to the establishment of two oppositely travelling waves on the conductor. It has therefore an electrical behaviour equivalent to that of a lumped resonant LC circuit and as such may be operated as a radio frequency transformer.

In order to be efficient any circuit behaving as a transformer must have small internal losses. A lumped LC circuit in resonance having small losses and significant reactance has a large Q factor. By analogy an efficient radio antenna should be operated in a condition in which it can develop high Q, being a condition in which standing wave phenomena grow to the extent at which the radiation emanating therefrom constitutes the principal energy loss. A good antenna and feed system should allow that resonant currents and voltages are restricted by neither dielectric, magnetic and resistive components in the insulators and conductors nor source impedance at the feed point.

In most previously described antenna feeds the feeder cable has been directly connected within the half-wave resonant dipole at a cut in the centre. Presently accepted mathematical analysis indicates that the input impedance at the said cut in a dipole radiating into free space is 73 ohms approximately. In order to prevent reflections on the feeder it has been usual to feed with a nearly matching feeder cable of 75 or 50 ohms characteristic impedance. Laudable as this has been in terms of preventing feeder reflections, it has a considerable disadvantage in limiting the Q factor of the antenna.

Such an antenna may be regarded as having an equivalent circuit comprising three branches in parallel: the radiation resistance, an inductance representing the inductance of the resonant conductors, and a capacitance representing the capacitance of the resonant conductors in series with the characteristic resistance of the coaxial feeder and a signal source. At resonance the magnitude of current in this circuit is limited by the characteristic impedance. By connecting an additional capacitor across the feeder the equivalent circuit is changed and the third branch becomes two capacitances in series across the inductance, with signals applied by the source in series with the characteristic resistance of the feeder across the additional capacitor. At resonance the currents circulating in the parallel branches rise in magnitude until power put into the radiation resistance becomes the principal loss in the circuit. The dual capacitive reactance provides the approximately correct impedance transformation between the said radiation resistance and the characteristic impedance of the feeder. Thus in an antenna according to the invention a capacitor connected across the first and second connecting points improves the Q factor of the antenna. Such an improvement also occurs in the multiband antennas described below.

A further important advantage of the invention as applied to single and multiband dipole antennas is now explained.

Since no asymmetry exists electrically in the constitution of an isolated bisected conductor fed by a feeder lying geometrically normal to it, then the centre cut impedance must be a balanced impedance. In spite of this self-evident fact, half-wave dipole antennas and Yagi-Uda arrays developed therefrom have until now usually been fed by means of a coaxial feeder cable which is an unbalanced feeder. Not surprisingly the expected benefit of the coaxial feeder, i.e. good protection against locally originated interference fields, has not been achieved. Not surprisingly also there are frequently unexplained standing wave problems present. For example in domestic UHF television systems it is normal to find that of the three equal power broadcast channels in the United Kingdom, one of the three is weaker than the other two at the coaxial feeder output to the receiver. Similar results occur in reception of VHF FM channels broadcasting high fidelity sound.

Balanced low impedance feeders have been recommended by a few design engineers but have not often been adopted in practice since such feeders when engineered for dipole and Yagi-Uda array matching impedances are dimensionally awkward to manufacture and install. Additionally the circuit engineering design of radio equipment is normally single ended, that is unbalanced, and therefore most receivers and transmitters have coaxial input and output connectors.

As will be apparent from the description below, where an antenna according to the invention includes one or more pairs of oppositely directed elongated conductors, a pair of capacitors may be connected in series between each pair of conductors and a balanced antenna and coaxial feeder arrangement can then be achieved. Since one of the capacitors also improves the Q of the antenna as explained above a greatly improved antenna results.

According to a second aspect of the invention there is provided an antenna comprising a structure having at least two pairs of substantially equal length, elongated first and second conductor portions, with, in each pair, one end of said first conductor portion adjacent to one end of said second conductor portion, the conductor portions of each pair being of substantially different combined lengths from the other of said at least two pairs, each of said first conductor portions being similarly directed, in close proximity with, but insulated from the other of said first conductor portions, each of said second conductor portions being in close proximity with, but insulated from the other of said second conductor portions, all of said second conductor portions being similarly directed opposite to said first conductor portions;

a number of pairs of capacitors equal to the number of pairs of elongated conductor portions, each pair of capacitors being connected in series between adjacent ends of an associated pair of conductor portions, respectively; and first and second connecting points for the connection of the inner and outer conductors of a coaxial feeder, said first connecting point being connected to one said adjacent end of one of said first conductor portions and said second connecting point being connected by way of one of said capacitors of each of said capacitor pairs to the adjacent end of each of said second conductor portions, each capacitor of each pair providing a phase shift of several tens of degrees between voltage and current applied thereto at a frequency at which the associated pair of conductor portions is of resonant length.

Preferably for a multiband antenna, if the longest pair of conductors is a half wavelength long at one frequency, then the other pair or pairs of conductors are approximately a half wavelength long at frequencies which are separated by a frequency interval of at least 10% of the said one frequency.

Such an arrangement provides a balanced multiband dipole antenna of high Q even when fed from a single coaxial feeder.

According to a third aspect of the present invention there is provided a multiband ground plane antenna, comprising a structure having a ground plane conductor and at least two spaced apart elongated conductor portions of different lengths normal to the ground plane conductor and in close proximity with one another, one end of each elongated conductor portion being adjacent to the ground plane conductor;

a plurality of capacitors, each connecting said one end of one of said conductor portions except the longest to said ground plane conductor; and first and second connecting points, for the connection of the inner and outer conductors of a coaxial feeder, connected to one end of the longest conductor portion and the ground plane conductor, respectively, each of said capacitors providing a phase shift of several tens of degrees between voltage and current applied thereto at a frequency at which the conductor portion connected to that capacitor has a resonant length.

Preferably an additional capacitor is connected between that end of the longest conductor adjacent to the ground plane conductor and the ground plane conductor, the additional conductor providing a phase shift of several tens of degrees between voltage and current applied thereto at a frequency at which the longest conductor has a resonant length.

Where the additional capacitor is not used the said phase shift is obtained by use of a small percentage diminution in conductor length.

In all three aspects of the invention the phase shift of several tens of degrees is preferably 45° or more.

Figure 2:
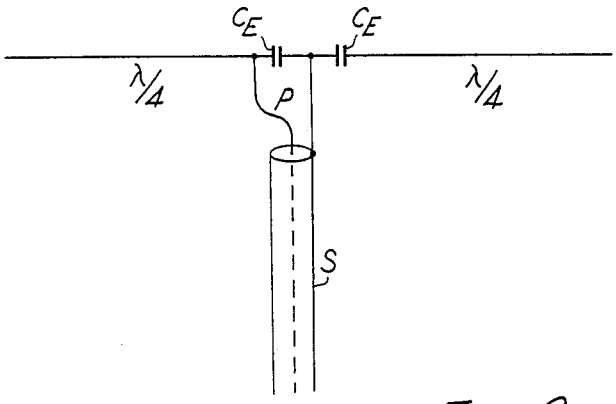
Figure 3:
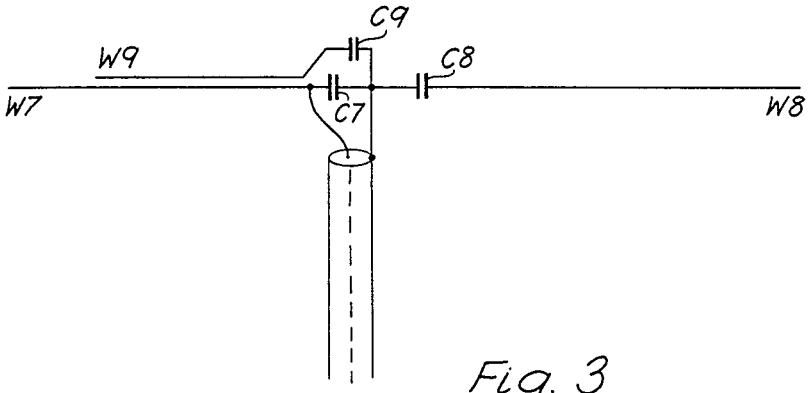
Figure 4:
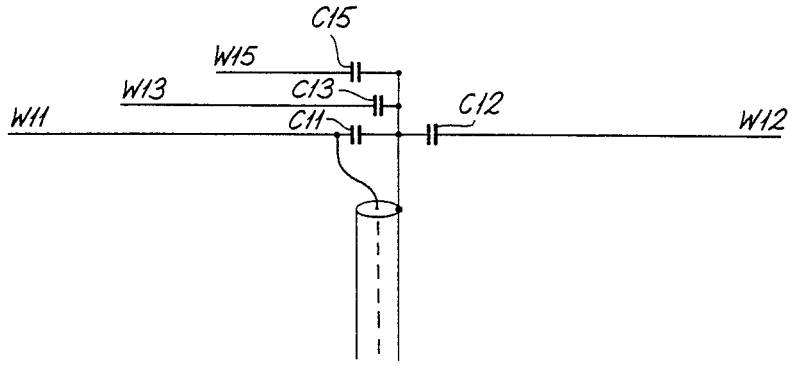
Figure 5:
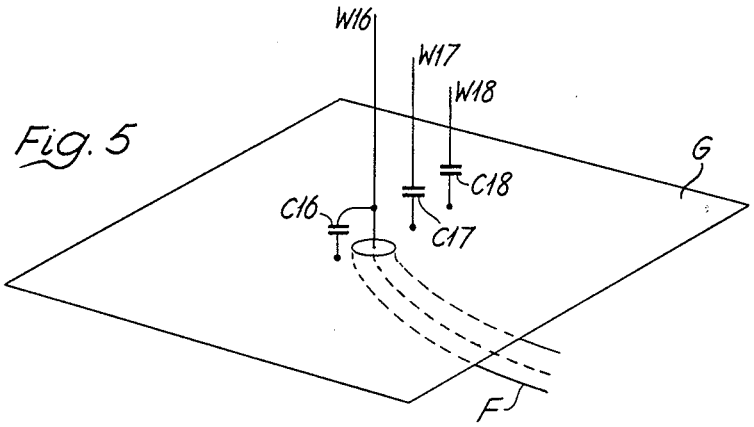
Figure 6:
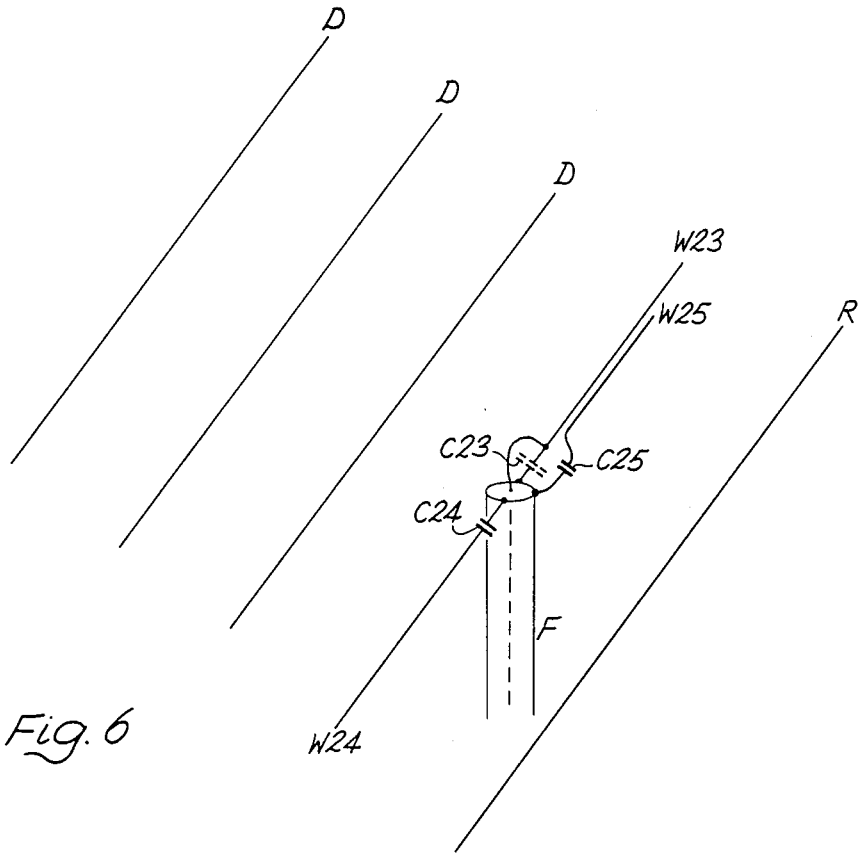
Figure 7:
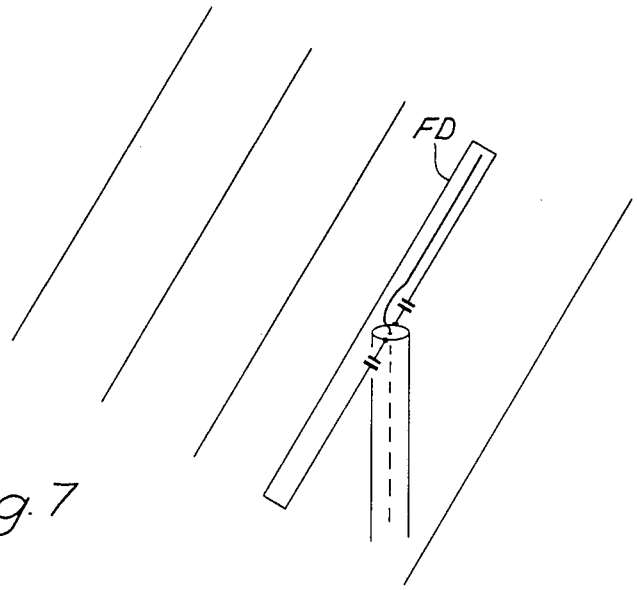
Figure 8:
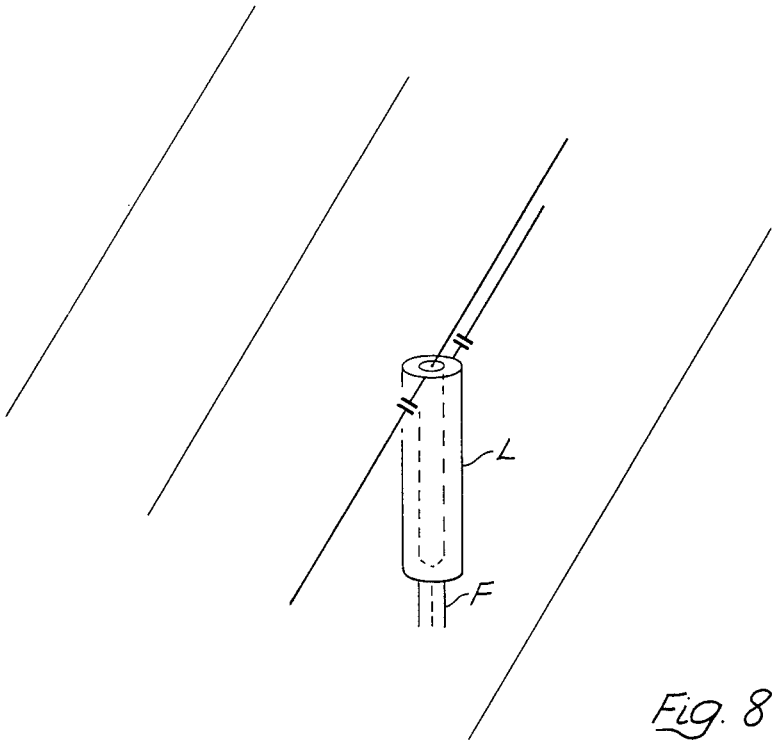
Figure 9:
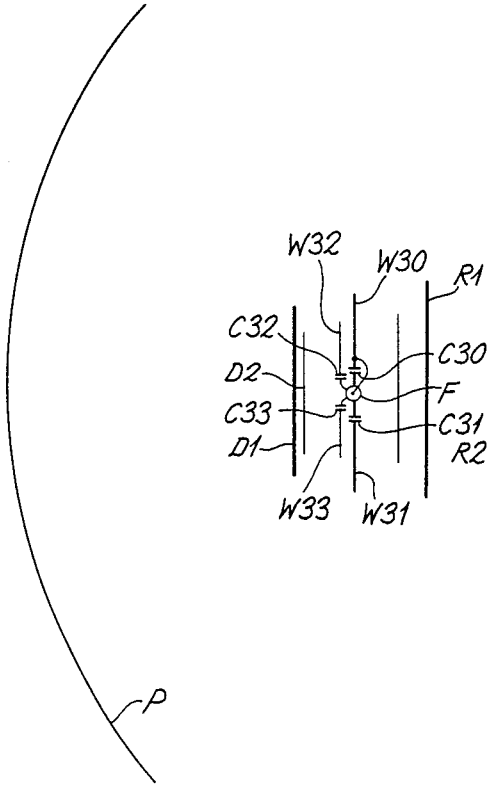

Certain embodiments of the invention will now be described with reference to the accompanying drawings, in which:

FIG. 1 shows a three-band half-wave dipole antenna according to the invention, FIG. 2 shows an equivalent antenna for any one of the frequency bands of the antenna of FIG. 1, FIG. 3 shows a single-band half-wave dipole antenna according to the invention, FIG. 4 shows an alternative three-band half-wave dipole antenna according to the invention, FIG. 5 shows a three-band ground plane antenna according to the invention, FIGS. 6, 7, and 8 show multiple element Yagi antennas according to the invention, and FIG. 9 shows a multi-band Yagi antenna according to the invention in use as the feed radiator of a parabolic reflector antenna.

In FIG. 1 elongated conductor wires W1 and W2 are each precisely one quarter of a free space wavelength for the lowest frequency band of the three-band antenna. The wire W1 is in close proximity with, but insulated from, other conductor wires W3 and W5, and the wire W2 is in close proximity with, but insulated from, wires W4 and W6. The wires W3 and W4 are approximately a quarter of a free space wavelength at the middle frequency band and the wires W5 and W6 are approximately a quarter of a free space wavelength at the highest frequency band.

A pair of capacitors C1 and C2 are connected in series between adjacent ends of the wires W1 and W2 and pairs of capacitors C3 and C4, and C5 and C6 are similarly connected between the wires W3 and W4, and W5 and W6 respectively. The six capacitors C1 to C6 are proportioned so that each resonant pair of wires and associated capacitors presents the same magnitude of capacitive reactance at the electrical centre of the antenna.

A coaxial feeder F is connected so that its screen and one plate of each of the six capacitors constitute a common centre connection about which the whole antenna is electrically balanced. The inner conductor of the coaxial feeder is connected to the junction between the wire W1 and the left-hand plate of the capacitor C1, thus providing the advantage of increased antenna Q explained above.

If the antenna of FIG. 1 is, for example, to operate at frequencies of f, 1.5f and 2f, the value of capacitors C5 and C6 is calculated from the reactance at the highest frequency band to be radiated, so that the said reactance is equal to the magnitude of the characteristic resistance $R_o$ of the coaxial feeder used. Thus the reactance of the capacitor C5 is $-jR_o$ ohms at 2f MHz and is equal to that of the capacitor C6. So $$C6=C5=1/2\pi\ 2f\,R_o \text{ Farad}$$

At the middle frequency band, the travelling waves on the wires W3 and W4 are able to obtain the use of the capacitors C5 and C6 by reason of the current sharing phenomenon described below. Consequently the values of the capacitors C3 and C4 are calculated so that the total susceptances of C3 added to C5, and of C4 added to C6, provide reactances at the middle frequency band 1.5f MHz equal to $-jR_o$ ohms. So $$C4+C6=C3+C5=1/2\pi\ 1.5f\,R_o \text{ Farad}$$

At the lowest frequency band the travelling waves on wires W1 and W2 similarly obtain the use of the three capacitors C1, C3 and C5, and of the capacitors C2, C4 and C6, respectively. Consequently the value of the capacitors C1 and C2 is calculated so that the total susceptances of C1 added to C3 and C5, and of C2 added to C4 and C6, provide reactances at the lowest frequency band f MHz equal to $-jR_o$ ohms. So $$C2+C4+C6=C1+C3+C5=1/2\pi\ f\,R_o \text{ Farad}$$

In order to preserve the electrical balance of the multiband dipole the feeder should preferably leave the dipole at right angles to the direction of the wires W1 to W6 for the maximum convenient distance, preferably at least one quarter of a wave of the lowest frequency f MHz. The total feeder length may be any desired length thereafter. The arrangement shown in FIG. 1 has typically been found to present to the coaxial feeder an input impedance which is close to the characteristic resistance $R_o$ and substantially resistive over about ±3 per cent either side of the centre frequency of each of three bands. Measurement of voltage standing wave ratio has been found to be typically 1.3 or less over these frequency ranges.

There is considerable coupling between the insulated wires W1, W3 and W5 so that energy is able to transfer between the fed wire W1 and the separately resonant half-wave dipoles constituted by wires W3 and W4 and their respective capacitors C3 and C4, and by wires W5 and W6 and their respective capacitors C5 and C6. The whole group of three wires at each side may be plaited or twisted or run straight according to the best form devised by the antenna manufacturer. However the overall group of wires and capacitors must be preserved from ingress of rainwater for otherwise the characteristic impedance of the group will be changed when wet, and excessive loss and poor voltage standing wave behaviour will occur. The exact length of the medium and high frequency band quarter wave wires will depend upon the actual form of the group of wires.

The capacitors may form part of a single assembly positioned at the centre of the dipoles. The capacitors may then be formed by a single common electrode connected to the screen of the feeder and six small electrodes each positioned opposite a different part of the common electrode and separated therefrom by a dielectric layer.

The operation of the coaxially fed three-band balanced dipole antenna of FIG. 1 may be explained as follows. Each band is provided with a separately resonant circuit comprising the two conductor wires, whose total length most nearly corresponds to the half wavelength at that frequency, and a respective pair of series capacitors. Since the wires are in close electromagnetic coupling as explained below, the standing wave of current at the lowest frequency band f MHz shares three capacitors at each side which are designed to be of such a magnitude that there is a capacitive reactance to the centre screen connection of the feeder to the dipole of $-jR_o$ ohms. Similarly the standing wave at the middle frequency band 1.5f MHz shares two of the centre capacitors each side and will also experience a reactance of $-jR_o$ ohms. At the highest frequency band 2f MHz, a standing wave exists only on wires W5 and W6 and flows only through one pair of capacitors, nameley C5 and C6. At this frequency the choice of values ensures that these capacitors also have reactance values of $-jR_o$ ohms. In this manner three individual standing waves can separately experience similar circuit reactances and have similar equivalent circuits. FIG. 2 shows the equivalent balanced half-wave dipole which each resonant wire pair resembles with the screen S of the coaxial feeder forming the voltage zero, or earth point, of the balanced system and the two equivalent capacitors $C_E$ shown in FIG. 2 having at each band a similar reactance magnitude $-jR_o$ ohms. Energy transfer from the feeder inner P is made via the direct connection to the left-hand quarter-wave wire, but because of the phase shift towards 90 degrees advance produced by the capacitor $C_E$, the travelling waves of current on the resonator are not controlled by the characteristic resistance of the feeder and may therefore rise to larger values than was possible in previously known coaxially fed half-wave dipoles. The travelling waves grow until the standing waves they compose develop radiation loss constituting the principal loss of the whole antenna. Radiation efficiency is therefore maximised automatically.

On all bands the capacitors in series with the quarter-wave wires not only ensure electrical balance and high efficiency, but also perform a vital role in the transfer of energy from wire to wire. At the lower frequency band f MHz, some of the current which leaves the inner conductor of the feeder flows on the conductor W1 originating a magnetic flux $\phi_1$ around itself and the neighbouring conductors W3 and W5, and inducing an electromotive force into these wires which is phased 90 degrees ahead of the magnetic flux. Due to the presence of capacitors C3 and C5, the current which flows is approximately 90 degrees of phase ahead of the electromotive force. Thus the currents on wires W3 and W5 are almost 180 degrees of phase ahead of the antiphase relationship expected between the primary and secondary currents of a magnetically coupled device according to Lenz's Law. Furthermore electric coupling exists between the conductors due to their close proximity because of the electric field across the insulation of the wires. The spreading of the induction fields of magnetic flux and electric displacement ensures that whatever happens on the left-hand half of the dipole multiband dipole spreads across to the right-hand half, where similar behaviour occurs and large amplitude travelling wave phenomena are established on the appropriate conductors. Thus at all separate frequencies to which conductors display either half-wave resonant behaviour or capacitive reactance behaviour (in virtue of their being at the said frequency less than a quarter of a free space wavelength), all currents and voltages are in phase. At the frequency f MHz all three capacitive reactances will be shared each side. At higher frequencies the travel times of waves on wires W1 and W2 are so much longer than those of travelling waves on their shorter companions that the capacitors C1 and C2 are not able to contribute significantly to the standing wave phenomena associated with the wires W3 and W4 at the frequency 1.5f MHz or with the wires W5 and W6 at the frequency 2f MHz.

Multiband antennas which will operate at other numbers of bands such as five or more may be constructed according to the invention using the above described procedure, that is all capacitors are so proportioned that when appropriately added they provide a reactance at each side of the centre point of reactance $-jR_o$ ohms. The shorter wires are cut to within plus 15% of the free space quarter wavelength at each frequency band to be radiated, depending upon wire diameter, insulation thickness, spacing and disposition. The longest wires are an exact quarter wavelength at the lowest frequency of operation. The current sharing and balancing phenomena at the centre capacitors is approximated towards the desired conditions in a benign manner in all cases.

The bands of frequency may be spaced out at any interval greater than a 10% frequency increment over a tenfold band of frequencies. For example if the lower frequency is f MHz, the others may be at 1.1f, 1.2f, 4.5f, 6.3f, etc., to 10f MHz. Many communications services have allocations over such spacings to enable continuous contact as ionospheric conditions change during the day.

Following this description it is now possible to explain the operation of the single band form of the above antenna.

A coaxially fed balanced monoband dipole is shown in FIG. 3. Wires W7 and W8 are each exactly a free space quarter wavelength, and a third wire W9 in close proximity but insulated from W7, is approximately $1/\sqrt{2}$ times the free space quarter wavelength. However the wire W9 may be any length shorter than the wire W7 which causes the transmission line set up between these two conductors to have an input impedance which is capacitive at the resonant frequency of the dipole. The purpose of the wire W9 is to allow energy transfer from the wire W7 to the wire W8 in the same way as described in connection with FIG. 1 but with the wire W9 acting instead of the wire W3. The spillover of the induction fields ensures that the monoband antenna develops the desired half-wave resonant behaviour and electrical balance. Capacitors C7, C8 and C9 constitute the electrical balance and phase shift capacitors similar to those of the previously described multiband antennas. The capacitor C7 may or may not be present since the transmission line effect of W7 and W8 together for 0.707 of a quarter of a wavelength presents a large capacitive susceptance across the feeder, whether or not the capacitor C7 is present. The capacitors C8 and C9, and C7 where used, are identical and each has a reactance of $-jR_o$ ohms at the frequency of operation.

Returning to a more complex antenna, if desired for reasons of materials economy or weight reduction for example, a multiband form of the previous monoband antenna may be constructed in the manner shown in FIG. 4. Conductor wires W11, W13 and W15 constitute the quarter wavelength resonant sections, and the single counterbalance wire W12 carries the counterpoise currents at any of the resonant frequencies.

Capacitors C11, C13 and C15 are chosen by a procedure similar to that for the multiband antenna previously described. A capacitor C12 is made equal to the total capacitance of C11, C13 and C15 added together.

Extension of the concept of FIG. 4 leads to a coaxially fed multiband group plane antenna which by way of example is shown in a three-band version of FIG. 5. The screen of the feeder F is connected at the centre of a wide conducting sheet G, or an effective metal conducting sheet composed of a mesh of metal or an array of radially disposed conductors, of minimum dimension in the ground plane at least half a free space wavelength at the lowest operating frequency. The inner conductor of the coaxial feeder is connected to a conductor W16 perpendicular to the sheet G. The conductor W16 is the largest of three conductors and is an approximate free space quarter wavelength at the lowest operating frequency band. Two conductors W17 and W18 constituting resonators at the other two operating frequency bands of this example are fixed in close proximity to but insulated from the conductor W16 and are separately connected by respective phase shifting capacitors C17 and C18. A capacitor C16 is shown connected between the lower end of the conductor W16 but may be omitted although the resulting antenna is of marginally poorer performance. The capacitors C16, C17 and C18 are proportioned in magnitude so that each conductor experiences a reactance of $-jR_o$ ohms at its own resonant frequency. A procedure similar to that given above for the multiband dipole antenna is used to select values for these capacitors.

The lengths of the middle and highest frequency conductor resonators may be a few percent longer than the free space quarter wavelength for the band to be radiated, depending upon the spacing and insulating material. Using appropriate spacing and electric coupling, operating bands separated in frequency by intervals as small as ten percent of the frequency of the lowest band can be obtained.

In all forms of antennas described, the choice of capacitor type, and conductor wire insulation must be decided having regard to dielectric loss rating expected.

The invention may be used in a Yagi array as shown in FIG. 6 where the feed is similar to that of FIG. 3. Capacitors C23 and C24 are connected between the outer conductor of a coaxial feeder F and conductors W23 and W24 to form a balanced dipole. A further wire W25 is in close proximity with the conductor 23 but has a length which is $1/\sqrt{2}$ times that of the wire W23 and is connected by capacitor C25 to the outer conductor of the feeder. Director elements D and a reflector element R have lengths, and are positioned, in the usual way for such an array. In a permissible variation, C23 is omitted.

Multiband forms of the above described array may also be constructed using a driven element of, for example, the form shown in FIG. 1 and director and reflector elements of graded lengths.

Since multiband Yagi arrays are known, the lengths and spacings of these elements is not given here (see for example "The Services Text Book of Radio", Volume 5, "Transmission and Propagation", E. Glazier and H. Lamont, Her Majesty's Stationery Office, 1958, page 376).

In arrays of the above mentioned types a considerable reduction in the impedance presented at the feed point occurs but there are many known techniques for overcoming this problem. For a monoband antenna, a closely spaced half wavelength element may be fixed in close proximity, or connected across the ends of the antenna in the manner of a folded dipole FD as shown in FIG. 7. Alternatively a short piece L of low impedance coaxial feeder (see FIG. 8) may be inserted between the centre of the antenna and the main coaxial feeder F. The piece L is cut to a length appropriate to transform the impedance up to the feeder impedance. For a multiband antenna, a ferrite cored transformer is necessary.

An antenna according to the invention, for example a multiband Yagi antenna, has an application as the feed radiator of a parabolic reflector antenna or of other types of reflector antenna. FIG. 9 shows a two-band dipole Yagi at the focus of a parabolic reflector used to produce a narrow beam of radio energy.

A coaxial feeder F, shown end on, has its centre conductor connected to a wire W30 which is a quarter wavelength long at the centre frequency of one band and its outer connected by way of a capacitor C31 to a wire W31 of equal length. A capacitor C30 is connected between the wire W30 and the outer of the feeder F. Another dipole with quarter-wave elements formed by wires W32 and W33 is resonant at the centre frequency of another band and the wires W32 and W33 are connected to the outer of the feeder by way of capacitors C32 and C33 respectively. Reflector elements R1 and R2 are of lengths and spacings for the first and second bands, respectively, as are director elements D1 and D2. The centre point of the array, that is the end of the feeder F, as shown, is at the focus of a parabolic reflector P.

I claim:

1. A multiband ground plane antenna, comprising:

a structure having a ground plane conductor and at least two spaced apart elongated conductor portions of different lengths normal to the ground plane conductor and in close proximity with one another, one end of each elongated conductor portion being adjacent to the ground plane conductor;

a respective capacitor associated with each of said conductor portions except the longest, each said capacitor connecting said one end of said associated conductor portion to said ground plane conductor, respectively and first and second connecting points, for the connection of the inner and outer conductors of a coaxial feeder, connected to one end of the longest conductor portion and the ground plane conductor, respectively, each of said capacitors providing a phase shift of several tens of degrees between voltage and current applied thereto at a frequency at which the conductor portion connected to that capacitor has a resonant length.

2. An antenna according to claim 1 including a further capacitor connected between the ground plane conductor and that end of the longest conductor portion which is adjacent to the ground plane conductor, the further capacitor providing a phase shift of several tens of degrees between voltage and current applied thereto at a frequency at which the longest conductor has a resonant length.

3. An antenna according to claim 1 wherein each said elongated conductor portion is associated with a respective band of frequencies, the longest conductor portion is substantially a quarter of a free-space wavelength at the centre frequency of the band associated with that conductor portion, and each other conductor portion has a length substantially between 1.05 and 1.15 times a quarter of a free-space wavelength at the centre frequency of the band associated with that conductor portion.

4. An antenna according to claim 1 wherein said conductor portions are distinct conductors.

5. An antenna comprising:

coupling means including a capacitor;

a structure having two elongated generally parallel conductor portions of different lengths in close proximity but insulated from one another and each having first and second ends, and one of a conductive ground plane generally normal to said two conductor portions and at least one other oppositely directed elongated conductor portion of the same length as one of said two conductor portions with one end adjacent to, and capacitively coupled through said coupling means to said first ends of said two conductors; and first and second connecting points for the connection of the inner and outer conductors, respectively, of a coaxial feeder, the first connecting point being coupled to said first end of the longer of said two conductor portions, said capacitor being coupled between said second connecting point and said first end of the shorter of said two conductor portions, said capacitor providing a phase shift of several tens of degrees between voltage and current applied to said capacitor at a frequency at which said conductor portion connected thereto has a resonant length.

6. An antenna according to claim 5 wherein said at least one other elongated conductor portion includes only a single elongated conductor portion, and said coupling means includes another capacitor for capacitively coupling said one end of the longer of the said two conductor portions with said single elongated conductor portion.

7. A multiband antenna according to claim 5 for connection to a coaxial feeder of characteristic resistance $R_o$ ohms, wherein:

said conductor portions having the same length are each substantially a quarter of a free-space wavelength long at a frequency f; and said apparatus further comprises additional conductor portions having lengths substantially between 1.05 and 1.15 times a quarter of a free-space wavelength at frequencies which are separated from each other by a frequency interval of at least one tenth, of f, the maximum frequency being up to ten times f, and an additional capacitor coupled between each said additional conductor portion and said second connecting point, the sum of the capacity of the capacitor connected between a particular one of said conductor portions and the second connecting point and every capacitor connected to a conductor portion which is shorter than said particular conductor portion is equal to $1/(2\pi yfR_o)$ Farads where the resonant frequency of said particular conductor portion is yf.

8. An antenna according to claim 6 wherein said two conductor portions are distinct conductors and said shorter of said two conductor portions is approximately $1/\sqrt{2}$ times the length of the other of said two conductor portions.

9. An antenna according to claim 6 for connection to a coaxial feeder of characteristic resistance $R_o$ ohms, wherein said capacitor coupled to said shorter conductor portion has a capacitance $1/(2\pi yfR_o)$ Farads and said another capacitor is connected between said single conductor portion and said second connecting point and has a capacitance of $1/(2\pi fR_o)$ Farads, where said shorter conductor portion and said single conductor portion are resonant at the frequencies yf and f, respectively.

10. An antenna according to claim 6 for use at a predetermined frequency wherein the longer of said two conductor portions and said single conductor portion are each substantially a quarter of a free-space wavelength long at the predetermined frequency.

11. An antenna comprising:

a structure having at least two pairs of substantially equal length, elongated first and second conductor portions, with, in each pair, one end of said first conductor portion adjacent to one end of said second conductor portion, the conductor portions of each pair being of substantially different combined lengths from the other of said at least two other pairs, each of said first conductor portions being similarly directed, in close proximity with, but insulated from the other of said first conductor portions, each of said second conductor portions being in close proximity with, but insulated from the other of said second conductor portions, all of said second conductor portions being similarly directed opposite to said first conductor portions;

a number of pairs of capacitors equal to the number of pairs of elongated conductor portions, each pair of capacitors being connected in series between adjacent ends of an associated pair of conductor portions, respectively; and first and second connecting points for the connection of the inner and outer conductors of a coaxial feeder, said first connecting point being connected to one said adjacent end of one of said first conductor portions and said second connecting point being connected by way of one of said capacitors of each of said capacitor pairs to the adjacent end of each of said second conductor portions, each capacitor of each pair providing a phase shift of several tens of degrees between voltage and current applied thereto at a frequency at which the associated pair of conductor portions is of resonant length.

12. A multiband antenna according to claim 11 wherein said first connecting point is connected to one said adjacent end of said first conductor portion of said pair having the longest combined length.

13. An antenna according to claim 12 wherein said conductor portions are distinct conductors, the conductors of said pair having the longest combined length each being equal in length to a quarter of a free-space wavelength at a frequency f and each conductor of each other of said pairs being approximately equal in length to a quarter of a free-space wavelength at frequencies which are separated from each other by a frequency interval of at least one tenth of f, the maximum frequency being up to ten times f.

14. An antenna according to claim 12 wherein the longest of said conductor portions is equal in length to a quarter of a free-space wavelength at a frequency f, and each other of said conductor portions is approximately equal in length to a quarter of a free-space wavelength at frequencies which are separated from each other by a frequency interval of at least one tenth of f, the maximum frequency being up to ten times f.

15. An antenna according to claim 12 for connection to a coaxial feeder of characteristic resistance $R_o$ ohms wherein the sum of the capacities of the capacitor connected to a particular one of the said conductor portions and every capacitor connected to a shorter one of said elongated conductor portions is equal to $1/(2\pi yf\ R_o)$ Farads where the particular conductor portion is approximately equal in length to a free-space quarter wavelength at a frequency yf.

16. An antenna according to claim 13 for connection to a coaxial feeder of characteristic resistance $R_o$ ohms, wherein the sum of the capacities of one capacitor of said capacitor pair connected between said conductors of any particular conductor pair and the capacities of one capacitor from every pair of capacities connected between conductors of shorter combined length than the particular pair of conductors is equal to $1/(2\pi yfR_o)$ Farads where the conductors of the particular pair are each approximately equal in length to a free-space quarter wavelength at a frequency yf.

17. An antenna according to claim 13 wherein each of said pairs of conductors is associated with a respective band of frequencies, each conductor of the conductor pair having the longest combined length has a length substantially equal to a quarter of a free-space wavelength at the centre frequency of the band associated with that pair of conductors, and each conductor of each other pair has a length substantially between 1.05 and 1.15 times a quarter of a free-space wavelength at the centre frequency of the band associated with that pair of conductors.

18. A Yagi antenna array comprising:

a driven structure having two elongated generally parallel conductor portions of different lengths in close proximity but insulated from one another and one other oppositely directed elongated conductor of the same length as one of said two conductor portions with one end adjacent to one end of said two conductors;

a passive conductor element spaced from and parallel to the said conductor portions;

first and second capacitors; and first and second connecting points for the connection of the inner and outer conductors, respectively, of a coaxial feeder, the first connecting point being coupled to said one end of the longer of said two conductor portions, said first capacitor being connected between said second connecting point and the shorter of said two conductor portions, and said second capacitor being connected between said second connecting point and said other conductor portion, each of said first and second capacitors providing a phase shift of several tens of degrees between voltage and current applied to that capacitor at a frequency at which the conductor portion connected thereto has a resonant length.

19. A Yagi array according to claim 18 including means for matching the array to a coaxial feeder.

20. A Yagi antenna array comprising:

a structure having at least two pairs of substantially equal length, elongated first and second conductor portions, with, in each pair, one end of said first conductor portion adjacent to one end of said second conductor portion, the conductor portions of each pair being of substantially different combined lengths from the other of said at least two pairs, each of said first conductor portions being similarly directed, in close proximity with, but insulated from the other of said first conductor portions, each of said second conductor portions being in close proximity with, but insulated from the other of said second conductor portions, all of said second conductor portions being similarly directed opposite to said first conductor portions;

a director element for each pair of elongated conductor portions;

a reflector element for each pair of elongated conductor portions;

a number of pairs of capacitors equal to the number of pairs of elongated conductor portions, each pair of capacitors being connected in series between adjacent ends of an associated one of said pairs of conductor portions, respectively; and first and second connecting points for the connection of the inner and outer conductors of a coaxial feeder, said first connecting point being connected to one said adjacent end of one of said first conductor portions and said second connecting point being connected by way of one of said capacitors of each of said capacitor pairs to the adjacent end of each of said second conductor portions, each capacitor of each pair providing a phase shift of several tens of degrees between voltage and current applied thereto at a frequency at which the associated pair of conductor portions is of resonant length.

21. An array according to claim 20 including means for matching the array to a coaxial feeder.

22. An antenna comprising:

a curved reflecting surface; and a driven structure, said surface being shaped and positioned to reflect, directionally, radio signals radiated by said structure, said driven structure having two elongated generally parallel conductor portions of different lengths in close proximity but insulated from one another and one other oppositely directed elongated conductor of the same length as one of the said two conductor portions with one end adjacent to one end of the said two conductors, a passive conductor element spaced from and parallel to the said conductor portions, first and second capacitors, and first and second connecting points for the connection of the inner and outer conductors, respectively, of a coaxial feeder, the first connecting point being coupled to said one end of the longer of said two conductor portions, said first capacitor being connected between said second connecting point and the shorter of said two conductor portions, and said second capacitor being connected between said second connecting point and said other conductor portion, each of said first and second capacitors providing a phase shift of several tens of degrees between voltage and current applied to that capacitor at a frequency at which the conductor portion connected thereto has a resonant length.

23. An antenna comprising:

a curved reflecting surface; and a driven structure, said surface being shaped and positioned to reflect, directionally, radio signals radiated by said structure, said driven structure having at least two pairs of substantially equal length, elongated first and second conductor portions, with, in each pair, one end of said first conductor portion adjacent to one end of said second conductor portion, the conductor portions of each pair being of substantially different combined lengths from the other of said at least two pairs, each of said first conductor portions being similarly directed, in close proximity with, but insulated from the other of said first conductor portions, each of said second conductor portions being in close proximity with, but insulated from the other of said second conductor portions, all of said second conductor portions being similarly directed opposite to said first conductor portions;

a director element for each pair of elongated conductor portions, a reflector element for each pair of elongated conductor portions, a number of pairs of capacitors equal to the number of pairs of elongated conductor portions, each pair of capacitors being connected in series between adjacent ends of an associated pair of conductor portions, respectively, and first and second connecting points for the connection of the inner and outer conductors of a coaxial feeder, said first connecting point being connected to one said adjacent end of one of said first conductor portions and said second connecting point being connected by way of one of said capacitors of each of said capacitor pairs to the adjacent end of each of said second conductor portions, each capacitor of each pair providing a phase shift of several tens of degrees between voltage and current applied thereto at a frequency at which the associated pair of conductor portions is of resonant length.

* * * * *